US005439254A

United States Patent [19]

Dorion

[11] Patent Number: 5,439,254

[45] Date of Patent: Aug. 8, 1995

[54] BOOKMARKER METHOD AND APPARATUS

[76] Inventor: Jeffrey P. Dorion, 1104 Donnell Dr., Port Orange, Fla. 32119

[21] Appl. No.: 939,921

[22] Filed: Sep. 2, 1992

[51] Int. Cl.[6] ..... B42D 9/00

[52] U.S. Cl. ..... 281/42

[58] Field of Search ..... 281/42, 45; 116/234, 116/239

[56] References Cited

U.S. PATENT DOCUMENTS 4,574,727 3/1986 Martin, Jr. ..... 116/234

4,848,799 7/1989 Turetsky ..... 281/42

*Primary Examiner*—Willmon Fridie

*Attorney, Agent, or Firm*—William M. Hobby, III

[57] ABSTRACT

A method of making a bookmarker includes selecting a sheet of material, coating a portion of the sheet of material with an adhesive and cutting a plurality of bookmarks from the sheet of material with each bookmark having an enlarged area having adhesive on one side and an elongated bookmarking portion extending from the enlarged portion. The material may be cut from a fiber reinforced paper, such as TYVEX, which can be readily printed upon or written or embossed on and can be attached to the outside of the spine of the book. The bookmarker may be a sheet of fiber reinforced paper material, such as TYVEX, having an enlarged portion and an elongated bookmarking portion with the enlarged portion having a microencapsulated adhesive coating over one side thereof so that the bookmark can be rapidly attached to a book spine. The bookmark may also be made from a transparent polymer material so as to appear invisible except upon close examination.

7 Claims, 1 Drawing Sheet

BOOKMARKER METHOD AND APPARATUS

BACKGROUND OF THE INVENTION

The present invention relates to an apparatus and method of making a bookmarker and especially to a bookmarker which may be attached to the spine of a book with an extending page marking portion and which has a surface which may be printed or written upon.

In the past, a variety bookmarkers have been provided including bookmarkers which are clipped or in some way removably attached to the pages of a book and bookmarkers which are attached to the spine of the book. One prior art U.S. Pat. No. to Dempsey 1,894,533, shows a bookmark having a retaining member for sliding into slits between the spine and spine cover of the book with a ribbon extending therefrom for marking the pages in the book. The prior U.S. Pat. No., to Evans 2,394,372, is for a bookmark for sliding behind the spine cover of the book and has a plurality of ribbons extending therefrom and includes an inserting tool for inserting a ribbon having an adhesive thereon into slots between the spine and spine cover. The U.S. Pat. No. 3,011,471, to Tam. shows a bookmark having a ribbon extending from a strip having adhesive thereon and a peel-off strip cover adhesive. The prior U.S. Pat. No. to Martin, Jr., No. 4,574,717, shows a bookmark which is installed by the user onto the book cover and includes a pressure sensitive adhesive attached to an anchor with a ribbon attached thereto and extending therefrom. The release backing on the Martin, Jr. patent includes a pull tab protruding from a portion of the anchor for easily removing the adhesive cover for attaching to the inside cover of the book with the tail extending from behind the cover for marking a page in a book.

The present invention, on the other hand, teaches a method of making a bookmark out of a one piece fiber reinforced paper which can be die cut in quantity and can have a microencapsulated adhesive on that portion of the bookmark being attached to the book. In addition, the material used for the present bookmark has a surface which can be printed or written upon and be coated or marked so that attaching the bookmark to the outside of the spine cover of the book can be used in the identification of the book or book type. In addition, company logos and promotional materials can be printed on the bookmark.

SUMMARY OF THE INVENTION

A method of making a bookmarker includes selecting a sheet of material, coating a portion of the sheet of material with an adhesive and cutting a plurality of bookmarks from the sheet of material with each bookmark having an enlarged area having adhesive on one side and an elongated bookmarking portion extending from the enlarged portion. The material may be cut from a fiber reinforced paper, such as TYVEX, which can be readily printed upon or written on and embossed and can be attached to the outside of the spine of the book. The bookmarker may be a sheet of fiber reinforced paper material, such as TYVEX, having an enlarged portion and an elongated bookmarking portion with the enlarged portion having a microencapsulated adhesive coating over one side thereof so that the bookmark can be rapidly attached to a book spine. The present bookmark can be used in books as well as accounting journals, ledgers, in magazines, and pamphlets. The sheet of material may also be a transparent polymer material so that the bookmark is not readily visible on the outside of the book.

BRIEF DESCRIPTION OF THE DRAWINGS

Other objects, features and advantages of the present invention will be apparent from the written description and the drawings in which.

DESCRIPTION OF THE PREFERRED EMBODIMENTS

Figure 1:
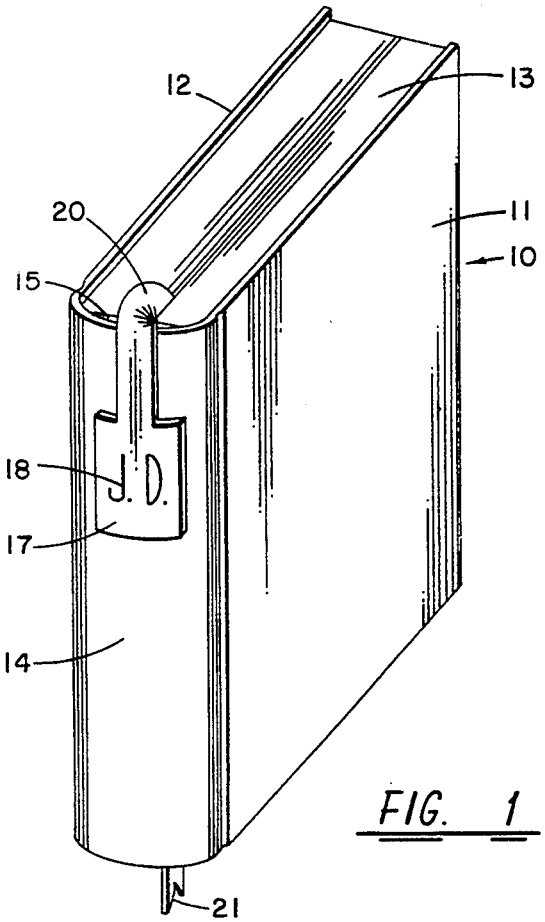
FIG. 1 is a perspective view of a book having a bookmark in accordance with the present invention attached thereto.
Figure 2:
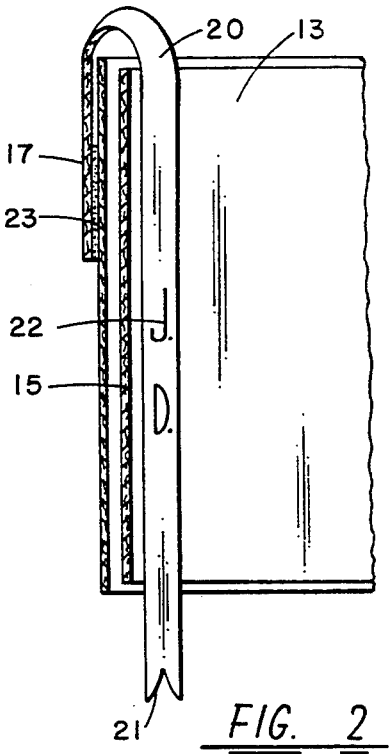
FIG. 2 is a sectional view taken through a portion of the book of FIG. 1.
Figure 4:
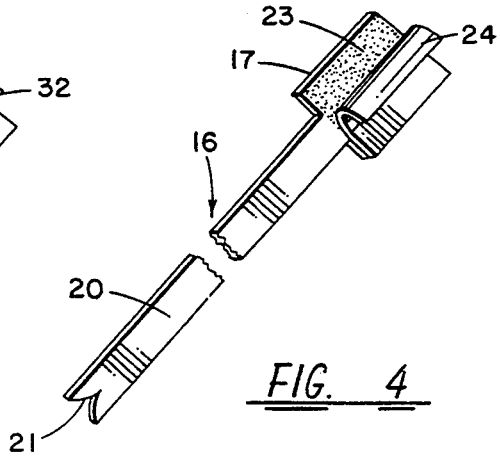
FIG. 4 is a perspective view of the bookmark in accordance with FIGS. 1 and 2.

Referring to the drawings and especially to FIGS. 1, 2, and 4, a book 10 can be seen in FIG. 1 having a front cover 11 and a rear cover 12 along with a plurality of pages 13 and having a spine 14 extending over the perfect binding 15 of the pages 13 of the book 10. The book 10 has a bookmark 16 in accordance with the present invention attached thereto having an enlarged spine attaching portion 17 attached to the outside of the spine cover 14 and having indicia or a design or logo 18 printed thereon. A tail or bookmarking portion 20 extends from the enlarged portion 17 and may also be printed upon or embossed, if desired, and has a cut decorative end 21. The bookmarking portion 20 may also have indicia or designs 22 printed thereon and the bookmark 16 can be seen having the adhesive 23 attaching the spine attaching portions 17 to the spine 14. The bookmark 16 spine attaching portion 17 can also be made of a transparent polymer which would tend to be invisible except on close inspection so as not to detract from the appearance of the book.

In the embodiment shown in FIGS. 1, 2 and 4, the bookmark 16 has been cut from a single sheet of fiber reinforced paper material, such as that sold under the trademark TYVEX, which is a strong durable paper which can be printed upon using lithographic printing but has the durability of a ribbon bookmark. In addition, the adhesive 23 can be a standard adhesive covered with a covering 24, such as a wax paper or the like, which can be quickly removed for attaching the enlarged portion 17 to the spine 14 of the book 10. Alternatively, the adhesive 23 can be a microencapsulated adhesive, such as commonly sold on products manufactured by the 3M Corporation and under the trademark POST-IT. Where a microencapsulated adhesive is used, the enlarged portion 17 can be attached to the spine 14, as illustrated in FIGS. 1 and 2, but can be readily removed and attached to another book if desired. The use of a fiber reinforced paper reduces the cost of bookmarks and also provides a material which is easily printed upon and which may be written or typed upon and which may be provided in different colors for coding the types of books in a library and to provide a decorative attachment to the spine 14 of the book 10. In addition, the use of microencapsulated adhesive is such that the bookmarks can be bound in pads.

Figure 3:
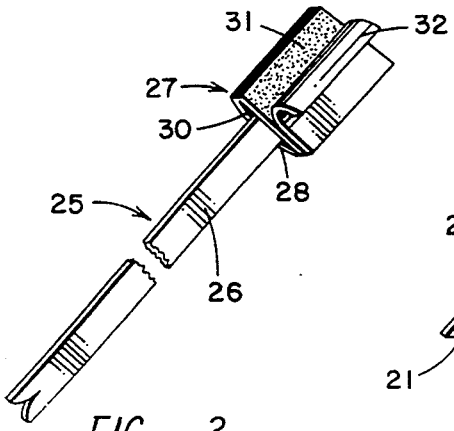
FIG. 3 is a perspective view of an alternate embodiment of the present bookmark.

Turning now to FIG. 3, an alternate embodiment of a bookmark 25 is illustrated having a ribbon 26 separately attached to the spine attaching portion 27 which may be attached between two layers 28 and 30, one layer of which has an adhesive 31 thereon which is covered with a covering material 32. The ribbon and the spine attaching portion can also be made of a fiber reinforced paper, if desired, but in any event has a surface which is easily printed or written upon. In addition, the adhesive 31 can be a microencapsulated adhesive.

Figure 5:
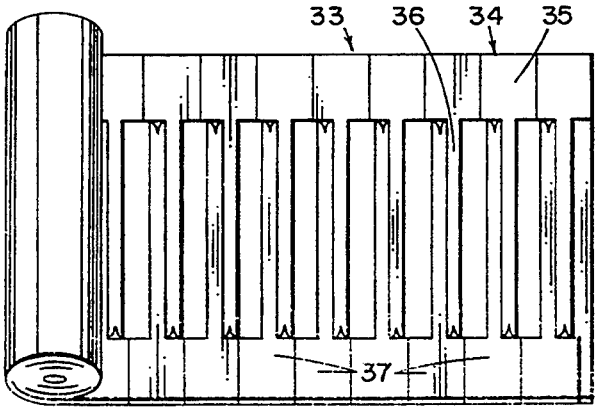
FIG. 5 is a perspective view of a roll of cut paper bookmarks being made in accordance with the present invention.

Referring to FIG. 5, a roll of fiber reinforced paper 33 has been die cut to provide a roll of bookmarks 34 alternately facing each other, each having an enlarged portion 35 and a narrow extending tail or ribbon portion 36. During the process of die cutting the roll 33, the enlarged portions 35 on one side and 37 on the other side can be simultaneously coated with an adhesive, such as a microencapsulated adhesive material, so that separating the bookmarks from the roll 33 produces any number of bookmarks made from paper and which can be inexpensively manufactured and marketed so that separate bookmarks can be attached to individual books and when color coded and marked, can be used in the rapid identification of the type of book in an individual's library and may be printed or written upon. In addition, the enlarged portion can be a company's advertisement or logo or merely decorative material to enhance the aesthetic value of the book itself.

It should be clear at this time that a bookmark has been provided which can be inexpensively produced which is both decorative and durable. However, the present invention is not to be construed as limited to the forms shown which are to be considered illustrative rather than restrictive.

I claim:

1. A method of making a bookmarker comprising the steps of:

selecting a sheet of fiber reinforced paper TYVEX;

coating a portion of said sheet of said fiber reinforced paper TYVEX with an adhesive; and cutting a plurality of bookmarks from said sheet of fiber reinforced paper TYVEX, each said bookmark having an enlarged area having said adhesive on one side thereof and an elongated bookmarking ribbon portion extending from said enlarged portion, whereby a bookmark has an enlarged portion attachable to said book spine with said elongated portion extending therefrom for marking a page in said book.

2. The method of making a bookmarker in accordance with claim 1 in which the step of coating a portion of said selected sheet of material includes coating with a microencapsulated adhesive.

3. The method of making a bookmarker in accordance with claim 1 including the step of covering said adhesive coated portion of said sheet of material with a protective covering.

4. The method of making a bookmarker in accordance with claim 1 including the step of selecting several sheets of material, each sheet being a different color whereby color coded bookmarkers are formed.

5. The method of making a bookmarker in accordance with claim 1 including the step of printing a design on said sheet of material,

6. The method of making a bookmarker in accordance with claim 5 including the step of printing a design on said sheet of material only on said enlarged portion,

7. The method of making a bookmarker in accordance with claim 1 including the step of embossing said selected sheet of material,

* * * * *